US005882142A

United States Patent [19]

Siglin et al.

[11] Patent Number: 5,882,142

[45] Date of Patent: Mar. 16, 1999

[54] CONTAINMENT DIKE ASSEMBLY AND METHOD FOR CONSTRUCTION THEREOF

[75] Inventors: Donald J. Siglin; Gary D. Seeba; William H. Hockenberry, Jr., all of Sioux Falls; Gerry D. Breen, Baltic, all of S. Dak.

[73] Assignee: Sioux Steel Company, Inc., Sioux Falls, S. Dak.

[21] Appl. No.: 707,306

[22] Filed: Sep. 3, 1996

[51] Int. Cl.[6] ..... E02B 7/20

[52] U.S. Cl. ..... 405/52; 405/91; 588/259

[58] Field of Search ..... 405/52, 91; 588/249, 588/259

[56] References Cited

U.S. PATENT DOCUMENTS

| | | | |
|---|---|---|---|
| 4,405,264 | 9/1983 | Brady et al. | 405/270 |
| 4,765,775 | 8/1988 | Kroger | 405/52 |
| 4,802,322 | 2/1989 | Bendfeld | 52/601 |
| 5,454,195 | 10/1995 | Hallsten | 405/52 X |

FOREIGN PATENT DOCUMENTS

| | | |
|---|---|---|
| 2606007 | 7/1993 | Canada . |
| 2107496 | 4/1995 | Canada . |

OTHER PUBLICATIONS

"Secondary Containment Rings", brochure by Sioux Steel Company Inc., Aug. 1995.

"Butler Containment Rings", brochure by Butler Grain Systems, 1994.

*Primary Examiner*—Tamara L. Graysay

*Assistant Examiner*—Tara L. Mayo

*Attorney, Agent, or Firm*—Jacobson, Price, Holman & Stern, PLLC

[57] ABSTRACT

An environmental control dike system constructed of a plurality of bolted steel sections supported by steel posts set in concrete below average frost depths, the interior area of the steel wall having a synthetic liner cover with mating geotextile pad, joined to the flanged top of the steel wall by a plurality of V-shaped steel clamps sized to securely form the synthetic liner and geotextile pad, compressed gently but firmly, into a 180 degree fold around the flanged top of the steel wall, the V-shaped steel clamp being held securely in place by a plurality of self drilling screws into the top flange of the steel wall. The connection between the steel wall and steel posts is secured with two bolts having a gasketed steel washer under the head of the bolt, the bolt passes through a round hole in the steel wall and through a slotted hole in the post allowing differential movement due to frost heaving between the post and the wall, the post having been set in concrete below average frost depth moves very little due to frost heaving of the soil, the wall sheet placed no more than six inches into the soil will be moved a greater distance due to frost heaving, the bolt passing through the slotted opening in the post having a concentric steel bushing with a dimension greater than the thickness of the steel post when the nut is tightened on the bolt prevents subsequent locking action between the post and the wall. The posts can support a fencing system thereby avoiding the need to install a duplicate system.

20 Claims, 6 Drawing Sheets

CONTAINMENT DIKE ASSEMBLY AND METHOD FOR CONSTRUCTION THEREOF

BACKGROUND OF THE INVENTION

There is a need for environmental control dike installations where the accidental release of stored chemicals poses a threat to the environment and human safety. There are many sites around the world where petroleum-contaminated process water, industrial chemicals, liquid agricultural chemicals or other corrosive chemicals are stored in tanks. When the tank or the connecting pipes fail the liquids are released into the environment with disastrous consequences to the environment and human safety. Business entities which maintain such facilities perform maintenance on the tanks and piping and also construct dikes to prevent the accidental spills from spreading. Most dikes are constructed of earth, concrete or wood in such a way as to be permanent. Expansion for added capacity is impractical and expensive. The permanent systems are costly and leave a permanent scar on the area, even when vacated.

One system of temporary concrete bolt together panels has no effective system of covering the horizontal surface of the ground inside the vertical walls.

Metal containment dike systems are known. These systems can be easily transported to remote locations and are easily assembled. They are useful for containment of many types of materials. Prior metal systems, however, are not useful in the containment of material such as liquid fertilizers, which are highly reactive to metals.

Prior metal systems having wall sections which are directly bolted to support posts are susceptible to frost heave damage. In particular, differential frost heavage between the wall sections and the support posts causes the seal of the containment wall to be compromised and requires costly maintenance.

A metal containment dike system is required which can be used for containment of corrosive liquids. A metal containment dike system is also required which can be used in areas where frost heavage is a concern.

Dike systems are often used in combination with fencing systems. The fencing systems act to prevent entry of animals and unauthorized personnel. Fencing systems are often installed outside of the metal containment system requiring installation of a duplicate set of posts in concrete.

A metal containment dike is required which can be combined with a fencing system.

SUMMARY OF THE INVENTION

A metal containment dike system is provided which is cost-effective and expandable. The system can provide for attachment of a liner rendering it useful for containment of metal-reactive liquids. The system can also accommodate differential frost heaving action between the support post and the wall sections. Alternately or in addition, the system provides for the attachment of a fence above the vertical wall section.

In accordance with a broad aspect of the present invention there is provided a containment dike system comprising: a wall constructed of metal forming an enclosure; and a flexible material lining the enclosure, the material being resistant to the passage of liquid therethrough.

In accordance with another broad aspect of the present invention, there is provided a containment dike system comprising a wall constructed of metal forming an enclosure, the wall including at least one wall section; at least one post for supporting the wall section, the wall section being secured to the post by a fastener engaging the wall section and extending through an aperture formed through the post, the aperture having a length and being sized to permit movement of the fastener along the length of the aperture while being retained therein; a flexible material lining the enclosure, the material being resistant to the passage of liquid therethrough and being secured to an upper edge of the wall.

In accordance with a further broad aspect of the present invention, there is provided a method for constructing a containment dike comprising: installing on a ground surface a wall formed of metal to form an enclosure; lining the enclosure with a flexible material resistant to the passage of liquid therethrough; and applying solid materials on the liner to cover a lower portion of the liner.

DESCRIPTION OF THE INVENTION

The metal dike system of the present invention includes a wall portion and a plurality of support posts. Together, the wall and posts form a continuous wall about a facility, such as a storage tank, to be contained. Preferably, a liner is disposed beneath the storage tank and is sealed to the walls. As such, a system for containment of liquids is provided.

Support posts are required along substantially straight wall sections in oblong, square or rectangular dikes. The support posts are installed securely in the ground, such as by setting in concrete. Preferably, the posts are set below average frost depths. The support posts can have any suitable form and can be manufactured from any suitable materials. Suitable posts are, for example, galvanized steel pipe or beams. In a preferred embodiment, the posts are formed as galvanized sheet steel beams with Z-shaped cross sections.

The wall portion extends substantially vertically upwardly from ground level and can be any desired height. The area within the wall and the height of the wall above ground level is usually selected with reference to the volume of liquid which is to be contained. The wall portion is generally formed in sections having predefined lengths, for ease of handling, and of any suitable metal materials such as, for example, corrugated galvanized steel. The wall sections are connected to each other along the length of the wall such as by the use of fasteners. Preferably, fasteners, such as bolts are inserted through alignable apertures and a sealant material is provided about the bolts and at the interface of the two segments.

The wall is secured to the support posts using any suitable means. In one embodiment, the wall is secured to each post by use of fasteners, such as bolts. The wall can be disposed with its lower edge at or preferably below the surface of the ground.

Where the dike system is installed in an environment where there is a risk of frost, an embodiment of the invention can be employed wherein the wall is secured to the support posts in such a way as to accommodate differential frost heavage between the wall and the posts. In this embodiment, the support posts have apertures for accepting a fastener acting between the wall and the post. The aperture is, as will be appreciated, sized such that the stem of a fastener can be inserted therethrough and retained therein by a nut. The aperture is formed to be elongate in a direction parallel with the long axis of the post so that a fastener, once inserted, can be moved along the length of the aperture. By use of the posts of the present embodiment, a fastener, such as a bolt can be fixed to the wall, such as by insertion through a hole, and can be secured in the elongate apertures. Movement of the wall by frost heavage relative to the post, will be permitted by movement of the bolt along the length of the aperture. It is to be understood that the fastener is inserted through the aperture in the post such that it is free to move along the length of the aperture. To facilitate such installation where a bolt/nut-type fastener system is used, a spacer, such as a bushing, is provided about the bolt stem for preventing overtightening of the nut onto the bolt. The spacer is preferably sized to space the nut from the wall a distance just greater than the thickness of the supporting post at the aperture.

Preferably, a liner is disposed beneath the ground surface within the containment area for preventing seepage of liquids through the ground. The liner is any suitable material for preventing passage of liquids therethrough. Preferably, the liner is a coated scrim such as, for example, at least 0.030 mil polypropylene coated polyester scrim or ELVALOY™ (trademark of DuPont) coated polyester scrim.

In another embodiment useful for the containment of chemicals which are reactive to metal, the surface of the wall facing the contained area is covered with a liner which prevents passage of liquid therethrough. Preferably, the liner covering the wall is an extension of the liner used to extend across the containment area and is secured to the wall in such a way that it is resistant to being torn away from the wall. In one embodiment, the liner is secured to the wall by means of a plurality of fasteners. In a preferred embodiment, the liner is folded over the upper edge of the wall and a U-shaped or V-shaped clamp having a base and a pair of upstanding walls is fixed over the upper edge of the wall and over the liner. Preferably, the clamp is formed of steel.

Fasteners are inserted to secure the clamp, liner and wall together. Preferably, the fasteners are self-drilling screws to avoid the necessity of aligning apertures. To permit the clamp to be tightly fit over the upper edge of the wall and the folded liner, the clamp can be notched, to permit bending along the length thereof. Preferably, also the walls of the clamp diverge as they extend away from the base, and are flexible so that the bracket can be easily fixed over the wall and liner without catching on the liner and then can be pressed together to secure the liner to the wall. Where a liner is used which extends to the upper limits of the wall, the seals between overlapping wall sections can be eliminated, if desired.

A corner bracket can also be provided to secure the liner at any wall corners. To reinforce the liner, a geotextile pad can be used with the liner. The pad is formed of any suitable material such as, for example polypropylene fibres, and is used as a second layer with the liner. In one embodiment, an 8 ounce polypropylene fabric is used. In an embodiment with a pad, both the pad and liner are folded over the upper edge of the wall and secured by means of the clamp.

Where a fence system is required to be installed in combination with the dike system, support posts can be used which can support a fencing structure. In this embodiment, a fence post is secured to the support post by any suitable means, such as for example, by fasteners. The fence post can be formed of any suitable materials capable of supporting fencing materials. In a preferred embodiment, the fence post is formed of a U-beam formed of galvanized sheet steel. A plurality of apertures are provided on the fence post for alignment with similarly spaced apertures formed on the support posts. Fasteners are disposed through the aligned apertures for securing the posts together. Fencing material is then secured to the fence posts. Where building code regulations require, fence posts formed of circular pipe can be used at the corners of the fence adjacent the corner of the wall.

To construct the dike system of the present invention, the supporting posts are securely installed in the ground about the area or facility to be contained. The posts are preferably installed below the average frost depth and preferably in concrete. The wall sections are then secured to the posts. The wall sections are positioned at or, generally, at most about 6 inches below the final ground surface level. The liner, and pad if desired, are extended over the surface within the dike and secured to the wall. Preferably, solid materials such as soil or gravel are placed on the liner at ground surface level to weight the liner from being moved about by wind.

If desired, where there is a risk of frost heavage, support posts can be used having elongate apertures for accepting the fasteners securing the wall sections to the posts. Where a fence is desired to be used in combination with the dike, supporting posts can be employed which are formed to accept fence posts thereon. Where the dike is to be used with liquids which are reactive to metal, the liner can be secured to the upper edge of the wall, preferably by use of a clamp.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
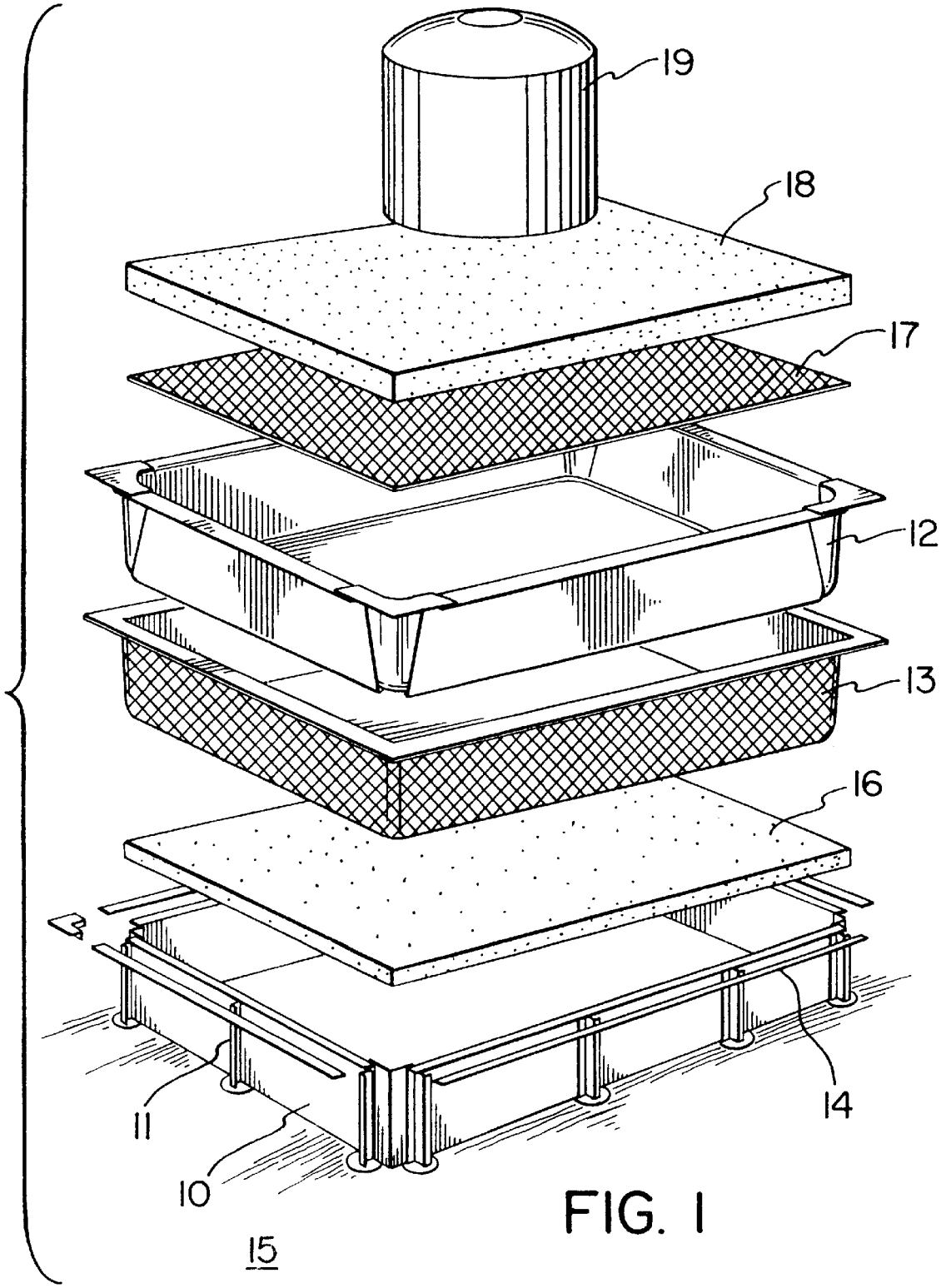
FIG. 1 is an exploded view of an embodiment of the environmental containment dike system of the present invention.

The preferred embodiment will now be described with reference to FIGS. 1 through 8. Referring to FIG. 1, an embodiment of an environmental control dike system is shown. The dike system is comprised of a plurality of steel wall sections 10 supported by posts 11. Posts 11 are preferably positioned to equalize the forces of pressure on the wall. The dike further includes a liner 12 and a geotextile pad 13 beneath the liner which covers the entire enclosure's internal floor and vertical wall sections. Liner 12 and pad 13 are securely fastened by a clamping device 14 to the upper edges of wall sections 10. The dike is constructed on a ground surface 15. In a preferred embodiment, the dike system includes a layer of sand 16 beneath liner 12 and pad 13. Preferably also, a piece of geotextile pad 17 and a layer of pea gravel 18 are disposed above the liner. The pea gravel 18 supports, for example, a tank 19 for storing liquid. It has been found that a 2 inch layer of sand and a 6 inch layer of pea gravel are particularly useful.

Figure 2:
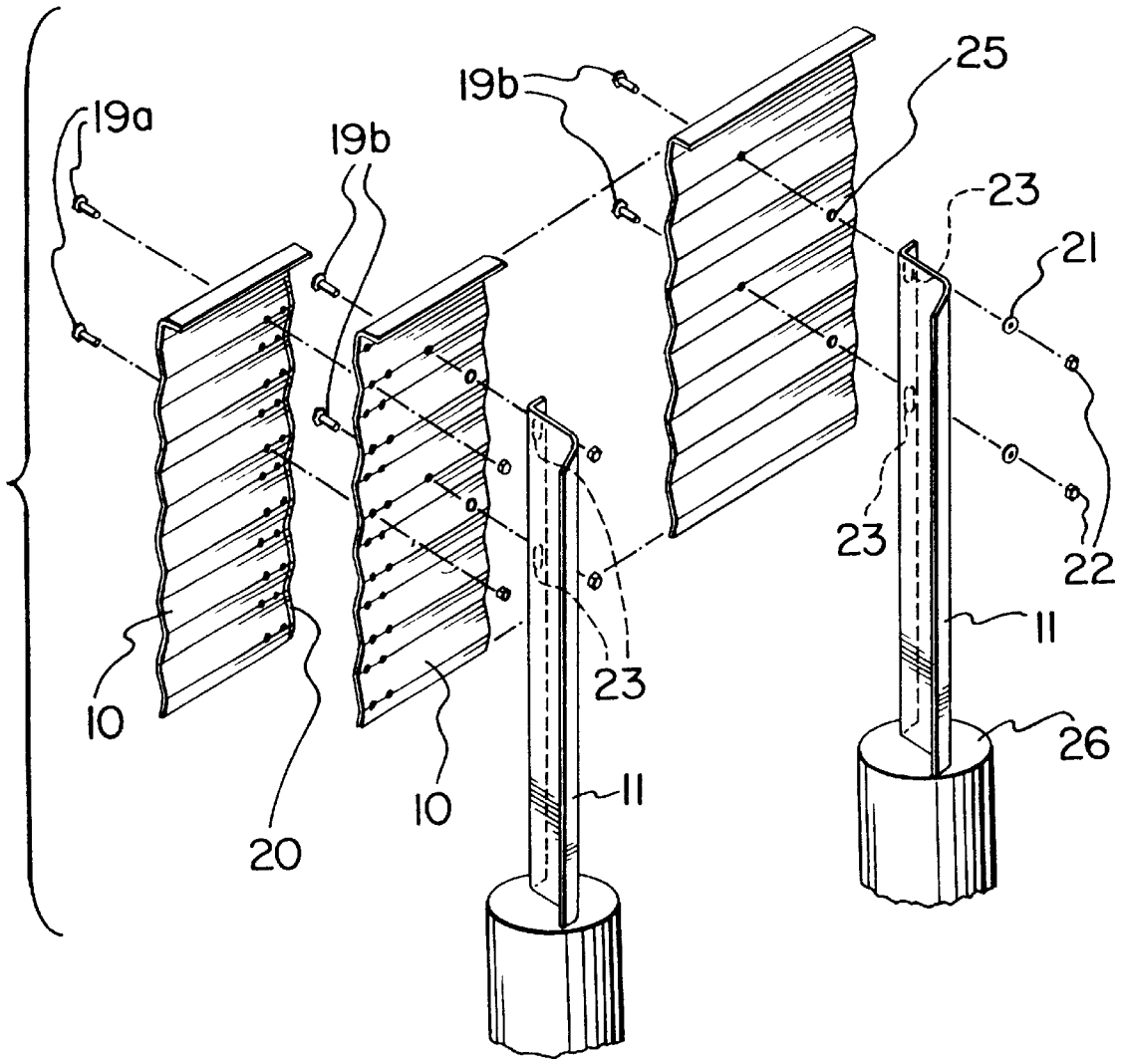
FIG. 2 is an exploded view of a post and wall of the invention.
Figure 3:
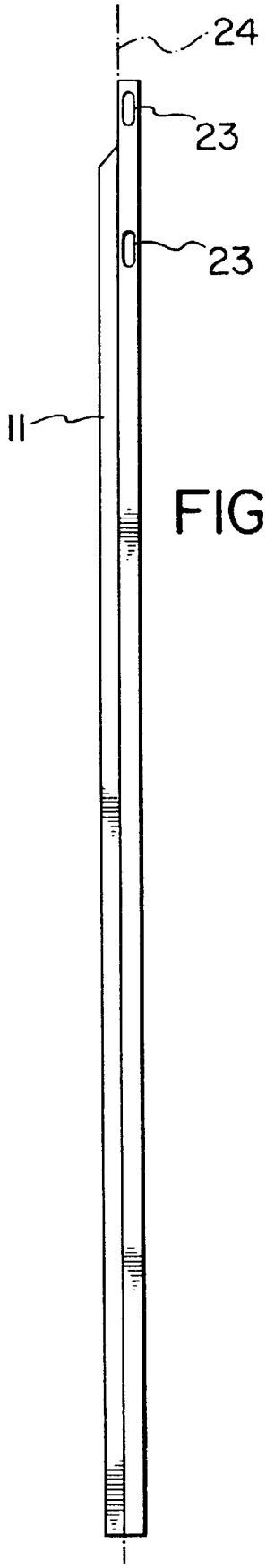
FIG. 3 is a front elevation view of a post useful in the present invention.
Figure 4:
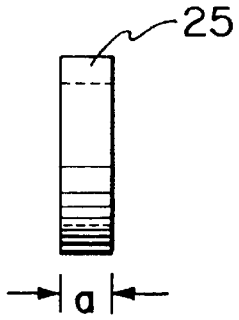
FIG. 4 is a side view of a bushing useful in the present invention.

Referring to FIGS. 2, 3, and 4, it has been found that wall sections 10 of between about 25 to 57 inches in height and 56 to 112.5 inches in length which are formed of 10 or 12 gauge high strength galvanized corrugated sheet steel are particularly useful. Sections 10 can be configured into round, oblong or rectangular shapes to almost any dimension.

Posts 11 are preferably formed from Z-beams of galvanized steel. Suitable lengths are from 6 to 12 feet depending on the height of the wall which is desired. The post spacing is preferably standard and preengineered eliminating the need for expensive engineering services to design containment to meet required capacities and permeability requirements.

The wall sections 10 are attached end to end by bolts 19*a* to form a continuous wall. A strip 20 of sealant is applied at the interface of the sections to create a seal therebetween. The wall sections 10 are secured to posts 11 by bolts 19*b*, washer 21 and nuts 22. To accommodate differential frost heave between the wall sections and the posts, elongate apertures 23 are provided on posts 11. Apertures 23 are preferably sized to permit bolts 19*b* to move within the aperture while being retained therein by means of nut 22 and washer 21. In particular, apertures 23 are preferably elongate in a direction parallel to the long axis of the post, indicated at 24. An aperture having a length of about 2 inches has been found to be particularly useful.

A bushing 25 is provided about bolt 19*b* to space nut 22 from wall 10 and prevent overtightening of nut 22. Bushing 25 is formed as a cylinder and has a length, indicated as a, which is selected to be greater than the thickness of the post at the aperture. The post 11 is set in concrete 26 below the average frost line and will heave very little due to frost. The steel wall 10 is set no more than 6 inches in the soil and will heave more than the post. The bushing 25 prevents the bolt 19*b* and nut 22 from locking the post 11 and wall section 10 together and allows them to move separately due to frost heave.

Figure 5:
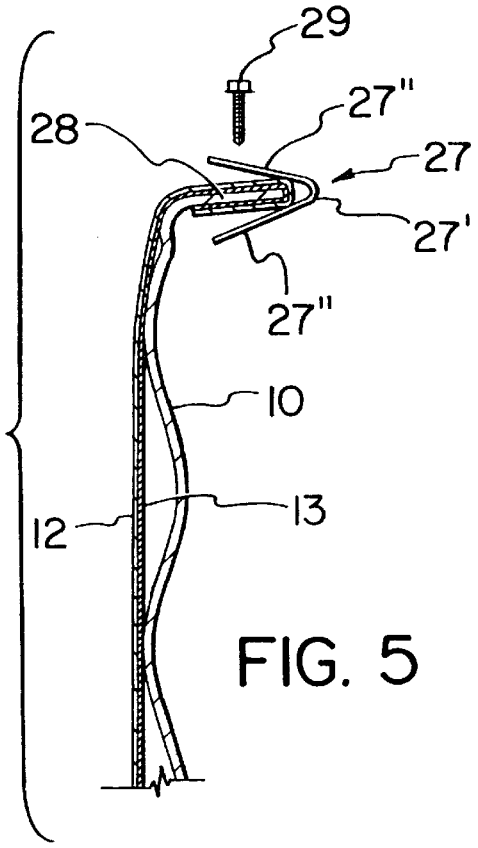
FIG. 5 is a cross sectional view through a wall showing the attachment of the liner to the wall according to the present invention.

Referring to FIG. 5, in a preferred embodiment, as shown, liner 12 and pad 13 are secured by clamps 27 to the upper edge of wall section 10, which is preferably shaped as a flange 28. The clamps 27 provide a double securing action and tightly retain the liner 12 and protective geotextile 13 around the flanged top 28 of the wall section 10. The clamp 27 is substantially V-shaped having a base portion 27' and a pair of upstanding walls 27". A plurality of drive screws 29 secure the clamp 27 to the flange 28 and compress the liner and pad therebetween. This double clamping action prevents tear out of the liner 12 and geotextile 13 around the drive screw 29. For the liner to tear loose from the drive screw, an entire liner area of approximately one foot wide would have to pull away from the clamp.

Figure 6:
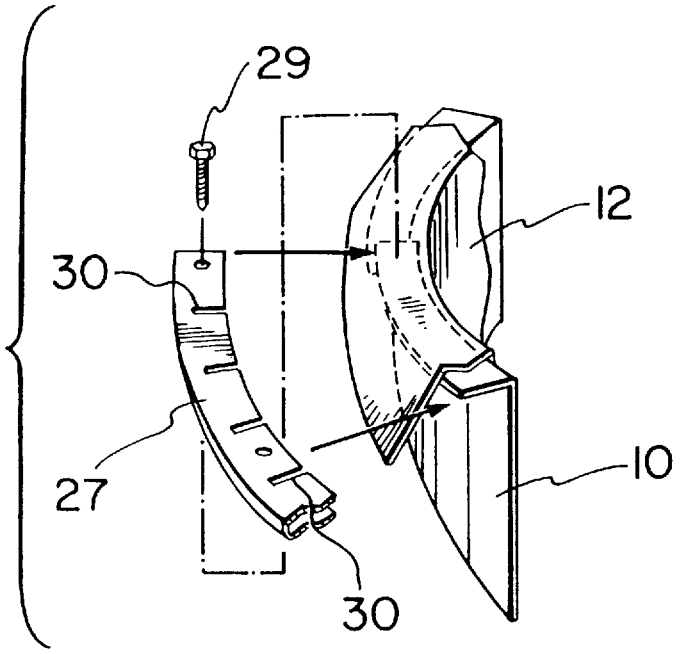
FIG. 6 is a perspective view partly in section showing the attachment of the liner to a curved wall according to the present invention.
Figure 7:
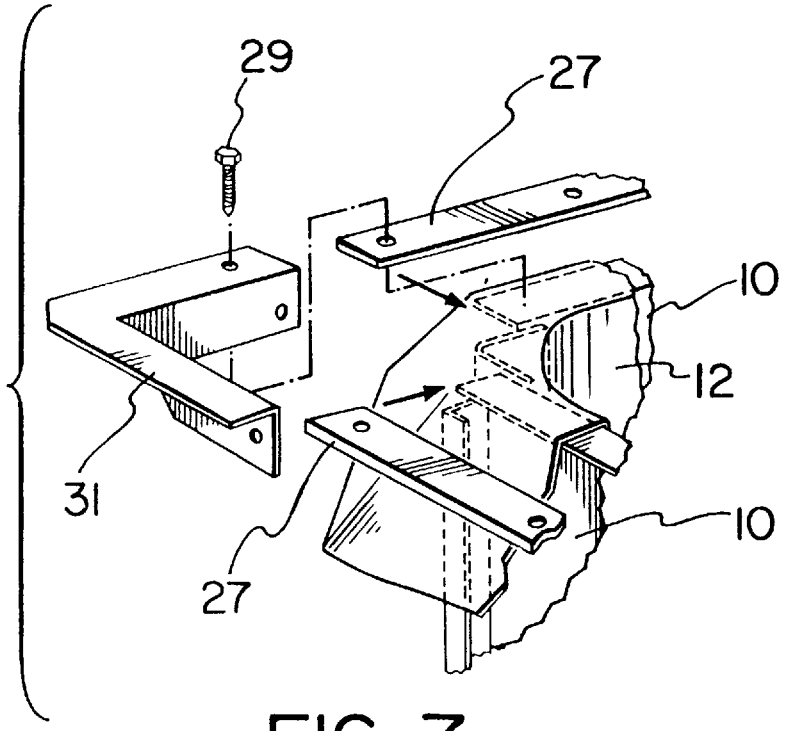
FIG. 7 is a perspective view showing the attachment of the liner to the wall at a corner.

Referring to FIG. 6, notches 30 can be formed in the walls of clamp 27 to facilitate bending along the length thereof for fitting over wall sections 10 which have been installed to form a curved wall portion. Referring to FIG. 7, a corner bracket 31 can be used where a pair of wall sections 10,10 come together to secure the liner.

Figure 8:
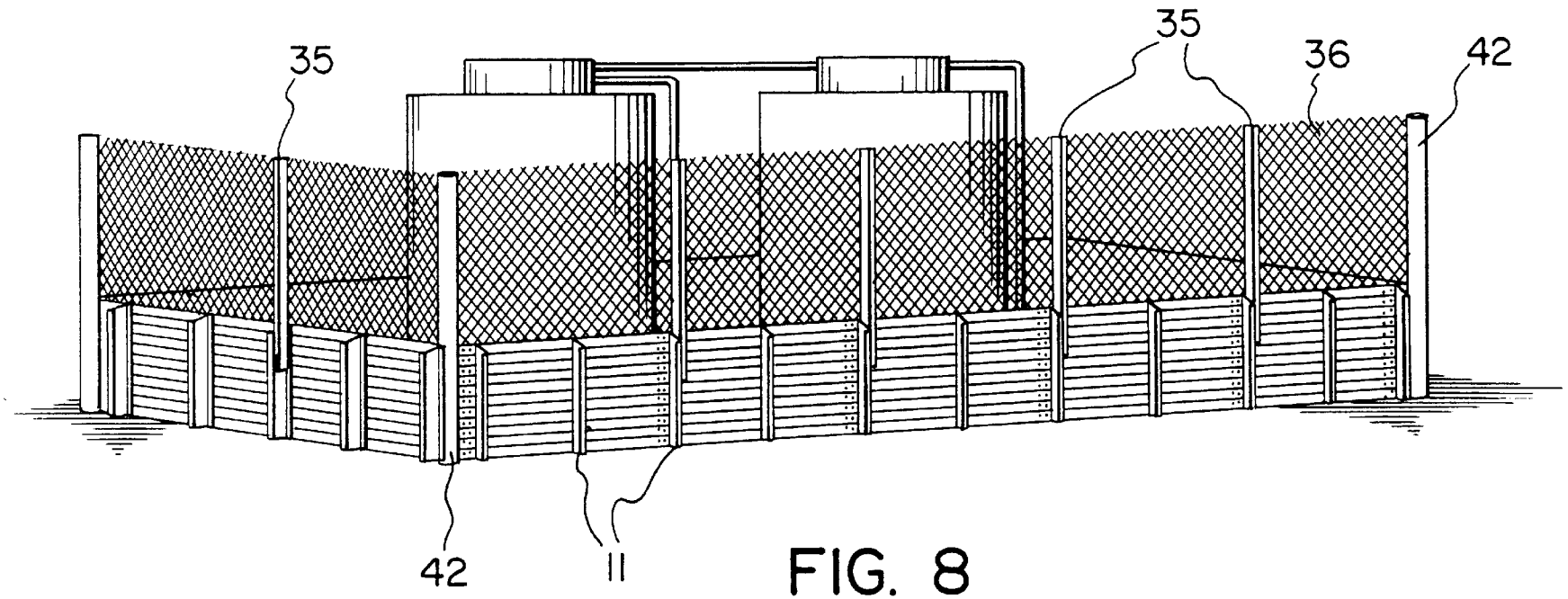
FIG. 8 is a perspective view of a dike system according to the present invention having a fencing system mounted thereon.
Figure 9:
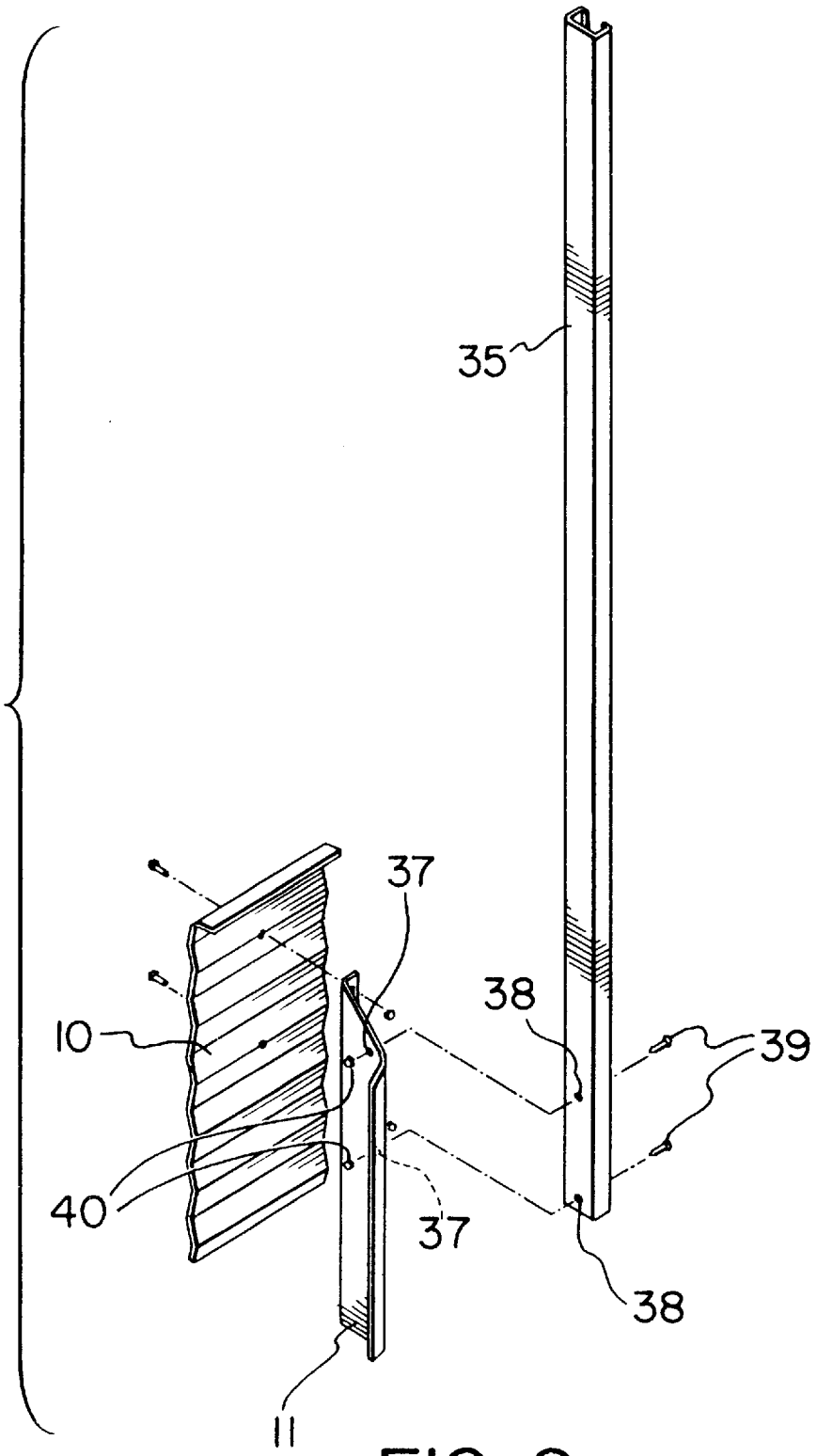
FIG. 9 is a perspective view showing the attachment of a fence post to a support post.

Referring to FIGS. 8 and 9, the dike system of the present invention can be combined with a fencing system to prevent entry by animals and unauthorized personnel. The fencing system includes a plurality of fence posts 35 and fencing material 36 mounted on the posts 11. Preferably, pipes 42 having a circular cross-section shape are placed in the corners of the fencing system. (A requirement of certain building codes). In a preferred embodiment, as shown, posts 11 have a pair of apertures 37 and posts 35 have a similarly spaced pair of apertures 38. Bolts 39 and nuts 40 secure post 11 to post 35 by acting through apertures 37 and 38, when aligned.

In order to construct a preferred dike system of the present invention, the site is first roughly leveled and the post holes dug. Once the site has been prepared sections 10 are deployed end to end around the planned enclosure area. Sections 10 and all other components are hauled to the site by any convenient means. Posts 11 are next bolted into position on the sections 10 by passing a bolt 19*b* through a hole in section 10, placing bushing 25 on bolt 19*b* and passing bolt 19*b* and bushing 25 through aperture 23 on post 11. Nut 22 is then threaded onto bolt 19*b* and tightened against bushing 25. The post and wall assemblies are set into the post holes one by one. As each successive section is set in place, the sections are bolted together with a tape mastic and a plurality of bolts 19*a* and nuts and washers. Once all sections are in place, concrete 26 is poured into the post holes and allowed to set up to form an enclosure.

A 2 inch layer of sand 16 is spread inside the enclosure. Next the geotextile 13 is placed on the sand layer 16 and draped over the top of the containment wall sections. The liner 12 is spread on top of geotextile pad 13 and is draped over the top of the containment wall. The liner and pad are pulled over the upper flange 28 of the wall as shown by the large arrows in FIG. 6 and 7. Clamps 27 are then installed, tightly clamping the liner and geotextile to the top of the containment wall. Screws 29 are then driven through clamp, liner, pad and flange. Geotextile layer 17 is placed on the ground level inside the enclosure on top of the liner. To secure the previous layers and protect the liner from the pressure of the filled storage tank 19 a 6 inch layer of pea gravel 18 is placed inside the wall area. Tanks 19 can then be installed inside the containment area.

Fence posts 35 can be mounted on post 11, as desired, and fencing 36 can be secured thereto. To facilitate construction, a section of the wall can be initially left out and the pea gravel layer can be spread with a skid loader. The skid loader operator can prepare his own "roadway" of gravel ahead of the skid loader as he spreads the gravel inside the enclosure. Shop built storage tanks of up to 30,000 gallons can then be backed throughout the open section and set in place with a hydraulic equipped truck bed. This eliminates the need for costly cranes on site to set storage tanks over concrete, dirt or wood walled dikes. Entire environmental dike systems can be installed with as little equipment as a skid loader, with post auger attachment. This equipment is inexpensive and easy to transport.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A containment dike system comprising:

a wall constructed of metal forming an enclosure and including at least one wall section;

at least one post for supporting the at least one wall section, the at least one wall section being secured to the at least one post by a fastener engaging the at least one wall section and extending through an elongate aperture formed through the at least one post, the elongate aperture being elongated in a direction parallel with a longitudinal axis of said at least one post and being sized to permit movement of the fastener along the length of the aperture while the fastener is retained therein to accommodate differential frost heavage between the at least one wall section and the at least one post; and a flexible material lining the enclosure, the material being resistant to the passage of liquid therethrough.

2. The containment dike system of claim 1, wherein the fastener is a bolt and is retained in the elongate aperture by means of a nut and the containment dike system further comprising a spacer disposed over the bolt for limiting the advancement of the nut along the bolt and for preventing the bolt and the nut from locking the at least one wall section rigidly to the at least one post.

3. The containment dike system of claim 2, wherein the spacer is a bushing telescopically disposed over the bolt and having a length greater than the thickness of the at least one post about the elongate aperture.

4. The containment dike system of claim 1, wherein the flexible material is attached to an upper edge of the wall.

5. The containment dike system of claim 4, wherein the flexible material is folded over the upper edge of the wall and a clamp is secured thereover, the clamp having a base and a pair of sidewalls extending therefrom.

6. The containment dike system of claim 4, further comprising a geotextile pad which mates with the flexible material.

7. The containment dike system of claim 1 wherein the at least one post is formed as a Z-beam and is formed to support a fence post thereon.

8. The containment dike system of claim 1, wherein any opening between the fastener and the at least one wall section is sealed to prevent passage of liquid therethrough.

9. A containment dike system comprising:

a wall constructed of metal forming an enclosure, the wall including at least one wall section;

at least one post for supporting the at least one wall section, the at least one wall section being secured to the at least one post by a bolt engaging the at least one wall section and extending through an elongate aperture formed through the at least one post, the bolt being retained in the aperture by means of a nut and a spacer disposed in association with the bolt for limiting the advancement of the nut along the bolt and for preventing the bolt and the nut from locking the at least one wall section rigidly to the at least one post and the elongate aperture being elongated in a direction parallel with a longitudinal axis of said at least one post and being sized to permit movement of the bolt along the length of the elongate aperture while being retained therein to accommodate differential frost heavage between the at least one wall section and the at least one post; and a flexible material lining the enclosure, the material being resistant to the passage of liquid therethrough and being secured to an upper edge of the wall.

10. The containment dike system of claim 9, wherein the spacer is a bushing telescopically disposed over the bolt and having a length greater than the thickness of the at least one post about the elongate aperture.

11. The containment dike system of claim 9, wherein the flexible material is folded over the upper edge of the wall and a clamp is secured over the flexible material and over the upper edge of the wall.

12. The containment dike system of claim 9, further comprising a geotextile pad which mates with the flexible material.

13. The containment dike system of claim 9 wherein the at least one post is formed as a Z-beam and is capable of supporting a fence post thereon.

14. The containment dike system of claim 9 wherein the wall includes a plurality of wall sections arranged in series to overlap at their ends and a sealant disposed between the overlapping ends.

15. A method for constructing a containment dike comprising:

forming an enclosure on a ground surface by securing a post in the ground surface, the post having formed therethrough an elongated aperture being elongated in a direction parallel with a longitudinal axis of said at least the post, securing a wall section to the post by means of a fastener, the fastener at its first end engaging the wall section and extending through the aperture of the post, positioning a spacer in association with the fastener and retaining the fastener in the aperture by installing a locking means on the fastener, the spacer acting to space the locking means a selected distance from the first end of the fastener to prevent the fastener and the locking means from locking the wall section rigidly to the post to accommodate differential frost heavage between the at least one wall section and the at least one post;

lining the enclosure with a flexible material resistant to the passage of liquid therethrough; and applying solid materials onto the flexible material in the enclosure to cover a lower portion of the flexible material.

16. The method of claim 15, wherein the step of lining the enclosure includes securing the flexible material to an upper edge of the wall section.

17. The method of claim 16, wherein the step of lining the enclosure with the flexible material includes folding the flexible material over the upper edge of the wall section and clamping the flexible material in place.

18. The method of claim 17, further comprising, prior to the step of lining, placing a geotextile pad in the enclosure and folding the geotextile pad over the upper edge of the wall section.

19. The method of claim 15 further comprising mounting a fence post on the post and securing fencing material to the fence post.

20. The method of claim 15 further comprising applying a sealant about the fastener to provide a seal against the passage of liquid through any opening between the fastener and the wall section.

* * * * *